United States Patent [19]

Dilworth et al.

[11] Patent Number: 4,823,518

[45] Date of Patent: Apr. 25, 1989

[54] LIFT MOUNTED SNOWMAKER

[75] Inventors: James L. Dilworth, Petoskey; Robert J. Brinks, Alanson, both of Mich.

[73] Assignee: Nubs Nob, Inc., Harbor Springs, Mich.

[21] Appl. No.: 933,319

[22] Filed: Nov. 19, 1986

Related U.S. Application Data

[63] Continuation of Ser. No. 709,939, Mar. 8, 1985, abandoned.

[51] Int. Cl.[4] ..... E01H 4/02; A01G 15/00; F25C 3/04

[52] U.S. Cl. ..... 52/40; 239/14.2; 239/280; 239/587

[58] Field of Search ..... 52/40, 27; 104/115, 104/173 ST; 239/25, 14, 276, 280, 281, 587

[56] References Cited

U.S. PATENT DOCUMENTS

| | | | |
|---|---|---|---|
| 730,402 | 6/1903 | Riblet | 104/115 |
| 2,571,069 | 10/1951 | Shearman | 239/2.5 |
| 2,582,201 | 1/1952 | Huntington | 104/173 ST |
| 2,676,471 | 4/1954 | Pierce, Jr. | 239/2.5 |
| 3,137,245 | 6/1964 | Spector | 104/173 ST |
| 3,529,626 | 9/1970 | German | 239/DIG. 14 |
| 3,761,020 | 9/1973 | Tropeano et al. | 239/2.5 |
| 3,814,319 | 6/1974 | Loomis | 239/2.5 |
| 3,945,567 | 3/1976 | Rambach | 239/14 |
| 4,199,103 | 4/1980 | Dupre | 239/276 |

FOREIGN PATENT DOCUMENTS

| | | | |
|---|---|---|---|
| 2017055 | 10/1970 | Fed. Rep. of Germany | 104/173 ST |
| 1073282 | 9/1954 | France | 104/173 ST |

*Primary Examiner*—Michael Safavi
*Attorney, Agent, or Firm*—Harness, Dickey & Pierce

[57] ABSTRACT

A snowmaker mounting structure is described useful for attaching a snowmaking apparatus used at ski resort areas to a ski lift tower. The structure includes a generally horizontally extending boom having one end attached to an upper portion of the ski lift tower and an extending end having a snowmaker attached thereto. Control over the region of ski slopes being covered with artifically produced snow is provided by rotatably mounting the snowmaker to the end of the boom by employing a generally vertically oriented collar through which a central tubular post is inserted and rotatable therein. The water supply is conducted to one end of the post and a pair of turning cables are connected to the post which, through tension being applied to either one of the cables, causes the snowmaker to be rotated with the collar. This invention eliminates the necessity of providing a separate snowmaker mounting tower.

9 Claims, 1 Drawing Sheet

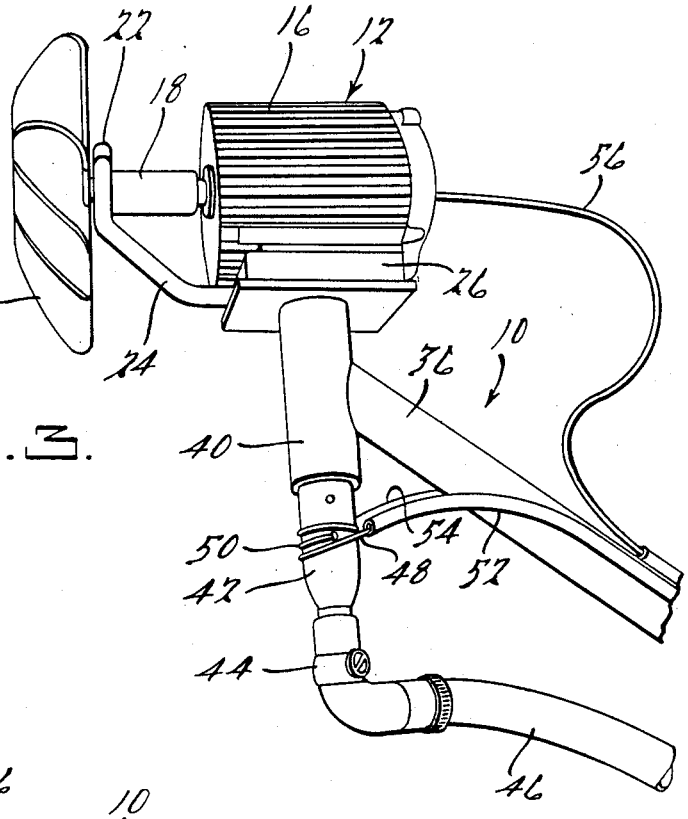
FIG. 3.
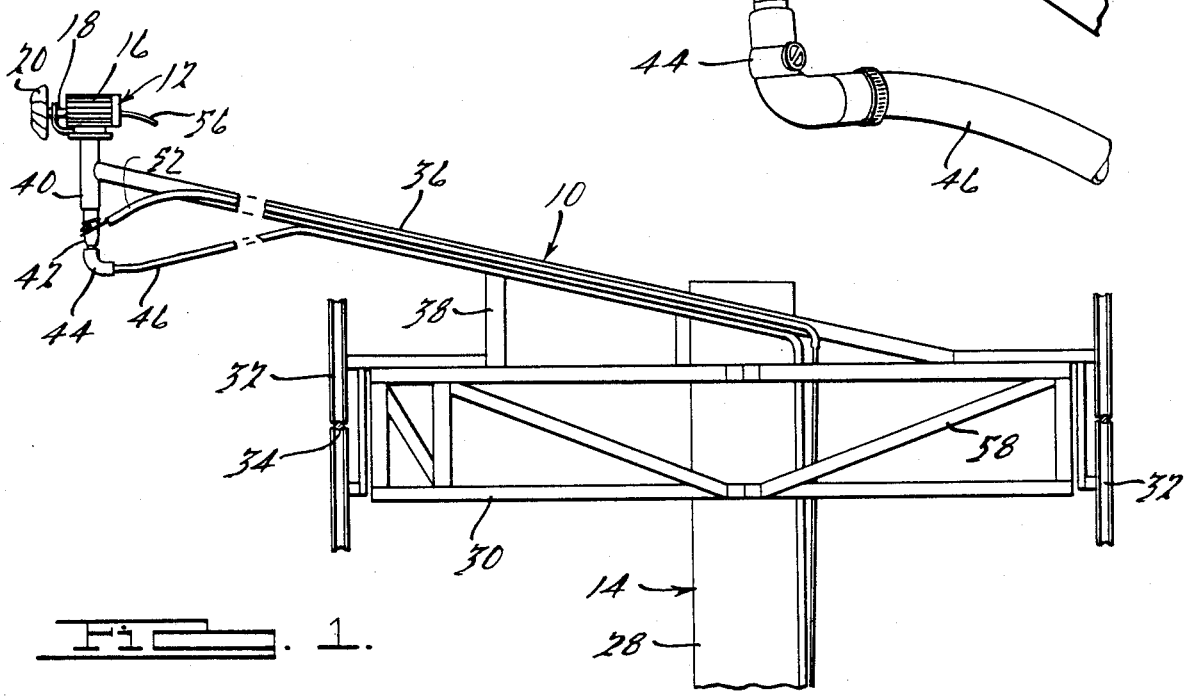
FIG. 1.
FIG. 2.
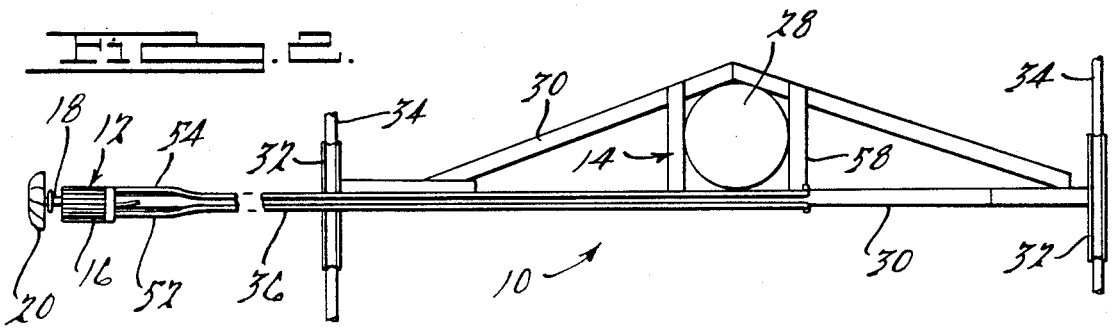

LIFT MOUNTED SNOWMAKER

This is a continuation of U.S. Pat. application Ser. No. 709,939, filed Mar. 8, 1985 now abandoned 1-23-87 entitled "LIFT MOUNT SNOWMAKER".

BACKGROUND AND SUMMARY OF THE INVENTION

This invention relates to artificial snowmaking and particularly, to a structure for mounting a snowmaking apparatus directly to a ski lift tower.

The unpredictability of the weather has made the making of artificial snow an essential aspect of the operation of virtually all successful ski resorts. Commercial snowmaking machines frequently include a high powered fan which creates a moving air mass which has atomized water injected into it. The cloud of atomized water made by the snowmaker freezes into ice crystals when atmospheric conditions permit. Typically, snowmaking machines are mounted to towers or posts which are provided specifically for that purpose. In addition to the costs and installation necessary for these snowmaking machine mounting towers, they further can constitute an obstacle which skiers must avoid.

In accordance with this invention, a structure is described which enables a snowmaking machine to be attached directly to an existing ski lift tower. The mounting system described herein eliminates the requirement of providing separate towers for each snowmaking machine, thereby reducing costs of components and installation in providing such snowmaking equipment. Further, since ski lift towers are typically taller than snowmaking machine mounting towers, superior performance is realized due to the greater vertical height at which the snowmaking machines are mounted. Another aspect of this invention is the provision of mechanisms which allow remote control of the rotational position of the snowmaking apparatus, thereby providing a degree of control over the area of the ski slopes which receive artificial snow.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 1 is a side view of the structure for mounting a snowmaking apparatus according to this invention shown with a snowmaking machine attached to one end and having another end affixed to a ski lift tower;

FIG. 2 is a top elevational view of the apparatus shown in FIG. 1; and

FIG. 3 is a side pictorial view of the extreme end of the structure shown in FIGS. 1 and 2, providing a detailed view of the snowmaking apparatus attached thereto.

DETAILED DESCRIPTION OF THE INVENTION

A snowmaking machine mounting structure according to this invention is shown by each of the figures and is generally designated by reference character 10. Mounting structure 10 is useful for supporting a snowmaker 12 to a lift tower 14. With particular reference to FIG. 3, snowmaker 12 of the type most advantageously used in conjunction with this invention includes electric drive motor 16 which rotates drive shaft 18, causing rotation of impeller 20. Water is injected into the airstream created by impeller 20 by employing circular water manifold 22 which surrounds drive shaft 18 and includes a plurality of radially spaced orifices (not shown). Water is conducted to circular water manifold 22 through conduit 24. Drive motor 16 and conduit 24 are each attached to base structure 26. When drive motor 16 is energized and water is supplied under pressure to circular water manifold 22, water escapes through the orifices and comes into contact with the rotating blades of impeller 20 which causes the water to be dispersed and atomized. In favorable atmospheric conditions, the cloud of atomized water created by snowmaker 12 freezes into ice crystals which are deposited on the ski slopes.

Lift tower 14 is a conventional type employed with ski chair lifts. Lift tower 14 includes a generally vertically extending column 28 having a top structure comprising one or more cross members 30 which support pairs of spaced pulleys or sheaves 32. Reinforcement for cross members 30 is provided by braces 58. Lift cable 34, having ski lift chairs attached thereto, pass between or over individual pulleys 32 as the continuous loop chair lift system moves chairs uphill on one side and downhill on the other.

Snowmaking machine mounting structure 10 includes extending boom 36. Boom 36 may be of any elongated stock but is preferably a tubular iron pipe. Four-inch black pipe has been found useful for this application. Boom 36 has one end attached to a cross member 30 by welding or mechanical fasteners. Boom 36 may also be attached directly to column 28, again by fusion welding or mechanical fasteners. Since pulleys 32 typically extend above the highest of cross members 30, adequate clearance is provided by aiming boom 36 horizontally and vertically upward, as best shown in FIG. 1. Additional support for boom 36 is provided by leg 38, also best shown in FIG. 1.

The extending end of boom 36 has tubular collar 40 attached thereto. Post 42 passes through collar 40 and is rotatable therein. Anti-friction bearings may be provided to reduce the effort necessary to cause such rotation. The upper end of post 42 is attached to base structure 26 which includes a hollow, internal passageway which communicates with conduit 24. The lower portion of post 42 which extends from collar 40 includes an end to which swivel connection 44 is attached. Water supply conduit 46 is connected to the other end of swivel connection 44. Pressurized water provided by water supply conduit 46 is conducted through swivel conduit, within post 42, and thereafter into conduit 24 and circular water manifold 22.

Swivel connection 44 is provided to enable relative rotation to occur between post 42 and collar 40. Controllable rotation of post 42 is provided by employing turning cables 48 and 50. Cables 48 and 50 are wrapped around post 42 and attached thereto such that a tension on either one causes rotation of the post. Cables 48 and 50 pass through turning cable guides 52 and 54, respectively. Guides 52 and 54 are tubular in form and are attached to boom 36. Guides 52 and 54 may extend downwardly along column 28 or may terminate with an elbow portion as shown in FIG. 1. Cables 48 and 50 are tied down or attached to a control lever at ground level on column 28 which, when actuated, causes tension to be applied on either of cables 48 or 50, thereby causing post 42 and therefore snowmaker 12 to rotate. Such rotation provides control over the portion of ground being covered with artificially produced snow. Electric power supply cable 56 is also attached to boom 36 and is connected to drive motor 16. The other end of cable 56 extends downwardly along column 28 and is connected to a controllable source of electric power.

While the above description constitutes the preferred embodiments of the present invention, it will be appreciated that the invention is susceptible to modification, variation and change without departing from the proper scope and fair meaning of the accompanying claims.

What is claimed is:

1. A structure for mounting a snowmaker apparatus to a ski lift tower of the type having one or more cross members for supporting horizontally separated lift cable pulleys comprising:

a boom having one end portion affixed to said ski lift tower, a tubular collar affixed to the other end of said boom, a post disposed in said tubular collar and rotatable therein, said snowmaking apparatus attached to one end of said post, means for conducting water to said snowmaking apparatus, means for conducting electrical power to said snowmaking apparatus, and one or more cables wrapped around said post enabling controlling rotation of said post within said collar.

2. A structure for mounting a snowmaking apparatus according to claim 1 wherein a pair of said cables are wrapped around said post whereby tension on one of said cables causes rotational movement of said post in said collar in one rotational direction, and tension on the other of said cables causes rotational movement of said post in said collar in an opposite rotational direction.

3. A structure for mounting a snowmaking apparatus according to claim 1 wherein said one or more of said cables is guided by a tube attached to said boom.

4. A structure for mounting a snowmaking apparatus according to claim 1 wherein said boom extends horizontally and upwardly whereby said boom is above said pulleys and said snowmaker is located above said pulleys.

5. A structure for mounting a snowmaking apparatus to a ski lift tower of the type having one or more cross members for supporting horizontally separated lift cable pulleys comprising:

a boom having one end portion affixed to said ski lift tower, a tubular collar affixed to the other end of said boom, a tubular hollow post dispensed in said tubular collar and rotatable therein, said snowmaking apparatus attached to one end of said post, means for conducting water to the other end of said post thereby providing a water supply for said snowmaking apparatus, means for conducting electrical power to said snowmaking apparatus, and one or more cables wrapped around said post enabling controlled rotation of said post within said collar.

6. A structure for mounting a snowmaking apparatus according to claim 5 wherein said means for conducting water comprises a swivel connection attached, at one end, to said post and having another end to which a water supply conduit is attached.

7. A structure for mounting a snowmaking apparatus according to claim 5 wherein a pair of said cables are wrapped around said post whereby a tension load on one of said cables causes rotational movement of said post in said collar in one rotational direction, and a tension load on the other of said cables causes rotational movement of said post in said collar in an opposite rotational direction.

8. A structure for mounting a snowmaking apparatus according to claim 5 wherein said one or more of said cables is guided by a tube attached to said boom.

9. A structure for mounting a snowmaking apparatus according to claim 5 wherein said boom extends horizontally and upwardly whereby said boom is above said pulleys and said snowmaker is located above said pulleys.

* * * * *